US010618187B2

(12) United States Patent
Milligan

(10) Patent No.: US 10,618,187 B2
(45) Date of Patent: Apr. 14, 2020

(54) SCISSOR GUIDE

(71) Applicant: Donald Jason Milligan, Martin, TN (US)

(72) Inventor: Donald Jason Milligan, Martin, TN (US)

( * ) Notice: Subject to any disclaimer, the term of this patent is extended or adjusted under 35 U.S.C. 154(b) by 27 days.

(21) Appl. No.: 15/800,372

(22) Filed: Nov. 1, 2017

(65) Prior Publication Data

US 2018/0126576 A1 May 10, 2018

Related U.S. Application Data

(63) Continuation of application No. PCT/US2017/059183, filed on Oct. 31, 2017.

(60) Provisional application No. 62/418,002, filed on Nov. 4, 2016.

(51) Int. Cl.
*B26B 29/04* (2006.01)
*B26B 13/06* (2006.01)

(52) U.S. Cl.
CPC ..... *B26B 29/04* (2013.01); *B26B 13/06* (2013.01)

(58) Field of Classification Search
CPC ..... B65B 13/00; B65B 13/005; B65B 13/02; B65B 13/04; B65B 13/06; B65B 13/10; B65B 13/08; B26B 13/24; B26B 29/04; B26B 13/06
USPC ..... D8/51–57
See application file for complete search history.

(56) References Cited

U.S. PATENT DOCUMENTS

| | | | | |
|---|---|---|---|---|
| 185,077 | A | 12/1876 | Coates | |
| 1,129,685 | A * | 2/1915 | Jones | B26B 29/04 30/233 |
| 1,322,085 | A | 11/1919 | Bertrand | |
| 1,604,004 | A | 10/1926 | Warner | |
| 1,712,086 | A * | 5/1929 | Little | B26B 21/34 30/83 |
| 1,904,399 | A | 4/1933 | Balthaser | |
| D118,280 | S | 12/1939 | Hausmann | |
| D147,416 | S | 9/1947 | O'Brien | |
| 3,325,897 | A * | 6/1967 | Luebkeman | B26B 13/00 30/254 |
| 3,600,806 | A * | 8/1971 | Naccash | A61B 17/0467 30/294 |

(Continued)

FOREIGN PATENT DOCUMENTS

| | | |
|---|---|---|
| CN | 2074703 | 4/1991 |
| CN | 201736247 | 2/2011 |

(Continued)

OTHER PUBLICATIONS

International Search Report in corresponding International Application No. PCT/US17/59183, dated Jan. 12, 2018, 12 pp.

(Continued)

*Primary Examiner* — Andrea L Wellington
*Assistant Examiner* — Fernando A Ayala
(74) *Attorney, Agent, or Firm* — Shane V. Cortesi

(57) ABSTRACT

A pair of scissors with at least one protective protrusion extending distally from the arm tip of at least one of the scissor arms is disclosed. The pair of scissors may include a cut-out in each scissor arm adjacent to the arm tip that forms a generally arc-shaped recess. The protective protrusion may be generally spherical or ovoidal in shape and may radiate in 360 degrees from the arm tip.

11 Claims, 11 Drawing Sheets

(56) References Cited

U.S. PATENT DOCUMENTS

| | | | | |
|---|---|---|---|---|
| 4,198,751 | A * | 4/1980 | Egbert | A22B 5/168 30/286 |
| D258,560 | S | 3/1981 | Stout | |
| 4,521,964 | A | 6/1985 | Maruyama | |
| 4,527,331 | A | 7/1985 | Lasner | |
| D285,166 | S | 8/1986 | Lee | |
| 4,807,364 | A | 2/1989 | Porat | |
| 5,195,245 | A * | 3/1993 | Malone | B26B 13/06 30/195 |
| 5,470,339 | A * | 11/1995 | Lerrick | A61B 17/3211 30/357 |
| 5,749,147 | A | 5/1998 | Hasegawa | |
| 5,964,038 | A | 10/1999 | DeVito | |
| 6,070,328 | A | 6/2000 | Hasegawa | |
| 6,158,128 | A | 12/2000 | Huff | |
| 6,182,364 | B1 * | 2/2001 | Reyburn | B26B 5/00 30/2 |
| 6,434,830 | B1 | 8/2002 | Wu | |
| 6,785,968 | B1 | 9/2004 | Stevens | |
| 7,166,119 | B2 * | 1/2007 | Olsen | A61B 17/3201 30/194 |
| 7,452,097 | B1 * | 11/2008 | Dunbar | B26B 13/06 362/109 |
| D613,141 | S | 4/2010 | Wang | |
| D773,268 | S | 12/2016 | Usman | |
| 2005/0203556 | A1 * | 9/2005 | Olsen | A61B 17/3201 606/174 |
| 2007/0019309 | A1 * | 1/2007 | Neal | B26B 13/22 359/844 |
| 2007/0175047 | A1 | 8/2007 | Cheng | |
| 2009/0000129 | A1 * | 1/2009 | Nakakoshi | B26B 13/00 30/232 |
| 2011/0302788 | A1 * | 12/2011 | Milligan | B26B 13/06 30/233 |
| 2013/0180115 | A1 * | 7/2013 | Greer | B26B 13/06 30/233 |
| 2013/0327348 | A1 * | 12/2013 | Ashur | A45D 29/00 132/73.6 |
| 2015/0047209 | A1 | 2/2015 | Schmidt | |

FOREIGN PATENT DOCUMENTS

| | | |
|---|---|---|
| CN | 201742862 | 2/2011 |
| CN | 103085085 | 5/2013 |
| CN | 203171670 | 9/2013 |
| CN | 203171671 | 9/2013 |
| CN | 104203507 | 12/2014 |
| CN | 104890017 | 9/2015 |
| JP | S55167367 | 12/1980 |
| JP | H06105968 | 4/1994 |
| JP | H0871261 | 3/1996 |
| JP | H0975561 | 3/1997 |
| JP | H09135629 | 5/1997 |
| JP | H09253350 | 9/1997 |
| JP | H1057640 | 3/1998 |
| JP | 2002210266 | 7/2002 |
| JP | 2004313386 | 11/2004 |
| JP | 2005304655 | 11/2005 |
| JP | 2012075752 | 4/2012 |
| KR | 200436168 | 6/2007 |
| KR | 20070072462 | 7/2007 |
| KR | 20080002615 | 7/2008 |
| WO | WO2004002336 | 1/2004 |
| WO | WO2004039543 | 5/2004 |
| WO | WO2016078066 | 5/2016 |

OTHER PUBLICATIONS

"Boys medium hair cut by fingers & Scissors" uploaded by Creative World, Apr. 27, 2015 (retrieved Dec. 19, 2017) Retrieved from the Internet<URL:https://www.youtube.com/watch?v=FwfDxZo3Ih4> 4 pp.

* cited by examiner

SCISSOR GUIDE

RELATED APPLICATIONS

This patent application is a continuation of International Patent Application PCT/US17/59183, filed Oct. 31, 2017, which claims priority under 35 USC 119 to U.S. Application Ser. No. 62/418,002, filed Nov. 4, 2016 and entitled "SPHERICAL GUIDE TIP SCISSORS", the entire contents of both which are incorporated by reference.

BACKGROUND

Technical Field

The present invention is directed to hair scissors.

Background of the Invention

Hair scissors have very sharp tips that can cut, scratch or puncture the barber's hands when cutting hair. Thus, there have been prior attempts to design hair scissors that are not prone to cutting the barber.

U.S. Pat. No. 5,964,038 teaches a pair of scissors that include dull rounded tips. Unfortunately, as known to users of safety scissors, while such scissors are safer, the efficacy of the scissors in cutting is diminished.

Thus, there is a need for hair and other scissors that are safer than traditional scissors but also do not have reduced cutting efficacy.

BRIEF SUMMARY

The present disclosure provides a pair of scissors.

In some embodiments, the pair of scissors include a pair of oppositely moveable scissor arms pivotably connected to each other by a pivot, the scissor arms each arm comprising an arm proximal end forming a handle in the form of a finger hole, an arm distal end forming an arm tip, an arm interior surface distal to the pivot, an arm exterior surface opposite the arm interior surface, an arm length extending from the pivot to the arm distal end, an arm leading/cutting edge, an arm lagging/back edge, an arm width perpendicular to the arm length and extending from the arm leading edge to the arm lagging edge, and an arm thickness perpendicular to the arm width and arm length and extending from the arm interior surface to the arm exterior surface. Optionally, the scissor arms are configured to pivot about the pivot from an open position in which the arm interior surfaces do not face each other to a closed position in which the arm interior surfaces face each other. Optionally, each scissor arm comprises a generally spherical protrusion extending distally from the arm tip and extending laterally beyond the arm tip in the widthwise direction and extending above and below the arm tip when the arm interior surfaces are positioned parallel to the ground. Optionally, the arm tips of the scissor arms do not touch or overlap each other and are disposed laterally to each other in the widthwise direction when the scissor arms are in the closed position. Optionally, the pair of scissors comprises a recess between the arm tips when the scissor arms are in the closed position.

Optionally, the generally spherical protrusions are removably attached to the arm tips. Alternatively, the generally spherical protrusions may be integral with the arm tips. Optionally, the generally spherical protrusions are substantially aligned in a plane comprising the arm widths when the scissor arms are in the closed position. Optionally, the generally spherical protrusions do not touch and are disposed laterally to each other in the widthwise direction but not necessarily in the same plane when the scissor arms are in the closed position. Optionally, the leading edge of each scissor arm represents the edge of the arm closest to the other arm when the scissor arms are in the open position, and further wherein the leading edge of each scissor arm comprises a cut-out adjacent to the arm tip and further wherein the cut-outs form the recess. Optionally, the cut-out of each arm is generally in the shape of one-half of an arc and further wherein the recess is generally in the shape of an arc. Optionally, the generally arc-shaped recess comprises an apex, and further wherein the leading edges of the scissor arms distal to the apex do not contact each other or overlap each other and are disposed laterally to each other in the widthwise direction when the scissor arms are in the closed position. Optionally, the leading edge of each scissor arm represents the edge of the arm closest to the other arm when the scissor arms are in the open position, wherein the recess comprises a proximal end and a distal end, and further wherein the leading edges of the scissor arms do not contact or overlap each other distal to the proximal end of the recess and are disposed laterally to each other in the widthwise direction when the scissor arms are in the closed position. Optionally, the leading edges of the respective scissor arms slope away from each other distal to the recess proximal end when the scissor arms are in the closed position. Optionally, the generally spherical protrusions radiate 360 degrees from the arm tips. Optionally, the generally spherical protrusions are located approximately the same distance from the pivot.

In still further embodiments, the present disclosure provides a method of using a pair of scissors by a barber to cut hair located on an animal, the barber having two hands, each hand comprising a plurality of fingers, the method comprising the steps of: a) providing the pair of scissors; b) placing two of the barber's fingers on one hand (e.g., on the right hand) in the handles; c) using the barber's fingers on the other hand (e.g., on the left hand) to position the animal's hair between the scissor arms; and d) moving the generally spherical protrusions distally along the barber's fingers on the other hand (e.g, on the left hand) while moving the scissor arms from the open position to the closed position to cut the animal's hair without cutting the user's fingers.

In still further embodiments, the present disclosure provides a pair of scissors comprising: a pair of oppositely moveable scissor arms pivotably connected to each other by a pivot, the scissor arms each arm comprising an arm proximal end forming a handle in the form of a finger hole, an arm distal end forming an arm tip, an arm interior surface distal to the pivot, an arm exterior surface opposite the arm interior surface, an arm length extending from the pivot to the arm distal end, an arm leading/cutting edge, an arm lagging/back edge, an arm width perpendicular to the arm length and extending from the arm leading edge to the arm lagging edge, and an arm thickness perpendicular to the arm width and arm length and extending from the arm interior surface to the arm exterior surface.

Optionally, the scissor arms are configured to pivot about the pivot from an open position in which the arm interior surfaces do not face each other to a closed position in which the arm interior surfaces face each other. Optionally, the leading edge of each scissor arm represents the edge of the arm closest to the other arm when the scissor arms are in the open position. Optionally, the pair of scissors comprises a recess between the arm tips when the scissor arms are in the closed position. Optionally, the leading edge of each scissor arm comprises a cut-out adjacent to the arm tip and further wherein the cut-outs form the recess. Optionally, the arm tips of the scissor arms do not touch or overlap each other and are disposed laterally to each other in the widthwise direction when the scissor arms are in the closed position. Optionally, at least one of the scissor arms comprises a protrusion extending distally from the arm tip and extending above and below the cut-out when the arm interior surfaces are positioned parallel to the ground.

Optionally, the protrusion is generally spherical. Optionally, the protrusion is ovoidal. Optionally, the protrusion is removably attached to the arm tip. Alternatively, the protrusion may be integral with the arm tip. Optionally, the cut-out of each arm is generally in the shape of one-half of an arc and further wherein the recess is generally in the shape of an arc. Optionally, the generally arc-shaped recess comprises an apex, and further wherein the leading edges of the scissor arms distal to the apex do not contact each other or overlap each other and are disposed laterally to each other in the widthwise direction when the scissor arms are in the closed position. Optionally, the recess comprises a proximal end and a distal end, and further wherein the leading edges of the scissor arms do not contact or overlap each other distal to the proximal end of the recess and are disposed laterally to each other in the widthwise direction when the scissor arms are in the closed position. Optionally, the leading edges of the respective scissor arms slope away from each other distal to the recess proximal end when the scissor arms are in the closed position. Optionally, the protrusion radiates 360 degrees from the arm tip.

The pair of scissors may be used in a method of using a pair of scissors by a barber to cut hair located on an animal, the barber having two hands, each hand comprising a plurality of fingers, the method comprising the steps of: a) providing the pair of scissors; b) placing two of the barber's fingers on one hand (e.g. on the right hand) in the handles; c) using the barber's fingers on the other hand (e.g. on the left hand) to position the animal's hair between the scissor arms; and d) moving the protrusion distally along a finger of the barber on the other hand (e.g., on the left hand) while moving the scissor arms from the open position to the closed position to cut the animal's hair without cutting the user's fingers.

In still further embodiments, the present disclosure provides a pair of scissors comprising: a pair of oppositely moveable scissor arms pivotably connected to each other by a pivot, the scissor arms each arm comprising an arm proximal end forming a handle, an arm distal end forming an arm tip, an arm interior surface distal to the pivot, an arm exterior surface opposite the arm interior surface, an arm length extending from the pivot to the arm distal end, an arm leading edge, an arm lagging edge, an arm width perpendicular to the arm length and extending from the arm leading edge to the arm lagging edge, and an arm thickness perpendicular to the arm width and arm length and extending from the arm interior surface to the arm exterior surface. Optionally, the scissor arms are configured to pivot about the pivot from an open position in which the arm interior surfaces do not face each other to a closed position in which the arm interior surfaces face each other. Optionally, the leading edge of each scissor arm represents the edge of the arm closest to the other arm when the scissor arms are in the open position. Optionally, the pair of scissors comprises a recess between the arm tips when the scissor arms are in the closed position. Optionally, the arm tips of the scissor arms do not touch or overlap each other and are disposed laterally to each other in the widthwise direction when the scissor arms are in the closed position. Optionally, at least one of the scissor arms comprises a protrusion extending distally from the arm tip and extending above and below the arm tip when the arm interior surfaces are positioned parallel to the ground.

Optionally, the protrusion extends laterally beyond the arm tip in the widthwise direction. Optionally, the protrusion is generally spherical. Optionally, the protrusion is ovoidal. Optionally, the protrusion is removably attached to the arm tip. Optionally, the protrusion is integral with the arm tip. Optionally, each arm comprises a cut-out, wherein the cut-out of each arm is generally in the shape of one-half of an arc and further wherein the recess is generally in the shape of an arc. Optionally, the generally arc-shaped recess comprises an apex, and further wherein the leading edges of the scissor arms distal to the apex do not contact each other or overlap each other and are disposed laterally to each other in the widthwise direction when the scissor arms are in the closed position. Optionally, the recess comprises a proximal end and a distal end, and further wherein the leading edges of the scissor arms do not contact or overlap each other distal to the proximal end of the recess and are disposed laterally to each other in the widthwise direction when the scissor arms are in the closed position. Optionally, the leading edges of the respective scissor arms slope away from each other distal to the recess proximal end when the scissor arms are in the closed position. Optionally, the protrusion radiates 360 degrees from the arm tip.

In still further embodiments, the present disclosure provides a method of using a pair of scissors by a barber to cut hair located on an animal, the barber having two hands, each hand comprising a plurality of fingers, the method comprising the steps of: a) providing the pair of scissors; b) placing two of the barber's fingers on one hand in the handles; c) using the barber's fingers on the other hand to position the animal's hair between the scissor arms; and d) moving the protrusion distally along a finger of the barber on the other hand while moving the scissor arms from the open position to the closed position to cut the animal's hair without cutting the user's fingers.

BRIEF DESCRIPTION OF THE DRAWINGS

in FIG. 1, the scissor arms are in the closed position.

in FIG. 23, the scissor arms are in the closed position.

DETAILED DESCRIPTION

Figure 1:
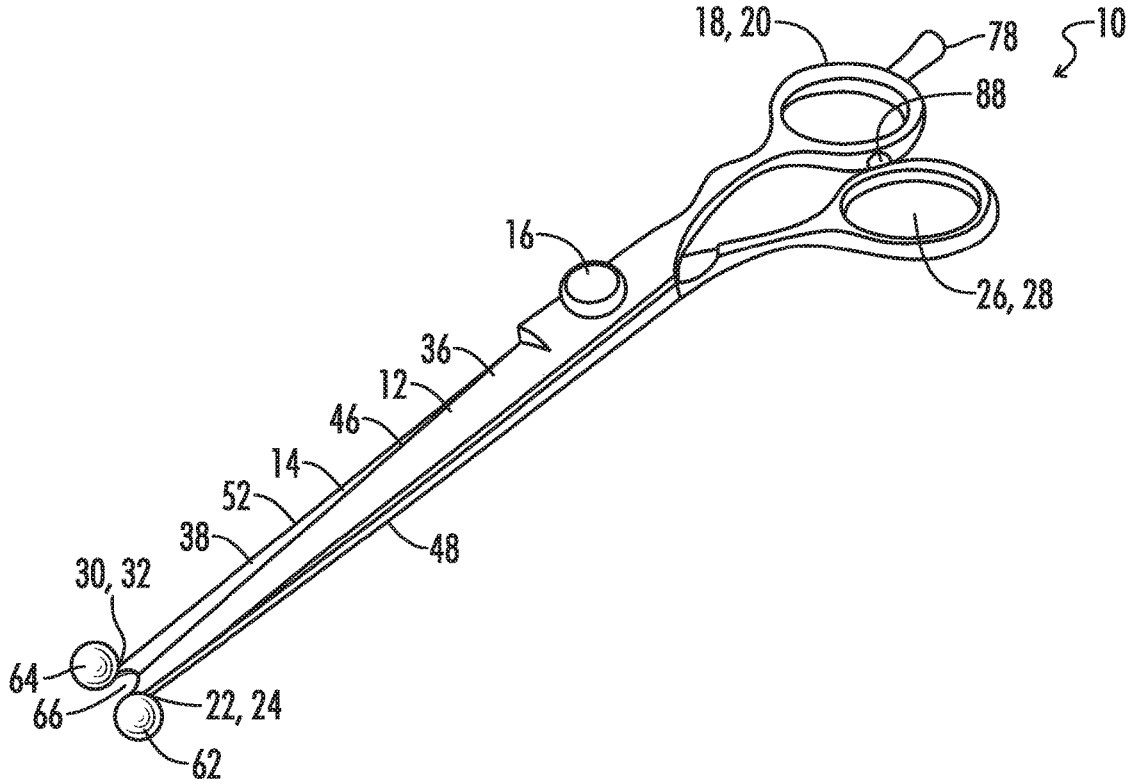
FIG. 1 is a side perspective view of a pair of scissors of one embodiment of the present invention.

With reference to FIGS. 1-24, the present invention provides a pair of scissors generally designated by the numeral 10. In the drawings, not all reference numbers are included in each drawing for the sake of clarity.

Referring further to FIGS. 1-24, the pair of scissors 10 may include a pair of oppositely moveable scissor arms/blades 12 and 14 pivotably connected to each other by a pivot 16. The first scissor arm 12 may include an arm proximal end 18 comprising a handle 20 in the form of a finger hole, an arm distal end 22 forming an arm tip 24, an arm interior surface 34 distal to the pivot 16 and facing the second arm 12, an arm exterior surface 36 opposite the arm interior surface 34, an arm length 42 extending from the pivot 16 to the arm distal end 22, an arm leading/cutting edge 46, an arm lagging/back edge 48, an arm width 54 perpendicular to the arm length 42 and extending from the arm leading edge 46 to the arm lagging edge 48, and an arm thickness 56 perpendicular to the arm width 54 and arm length 42 and extending from the arm interior surface 34 to the arm exterior surface 36. The second scissor arm 14 may include an arm proximal end 26 comprising a handle 28 in the form of a finger hole, an arm distal end 30 forming an arm tip 32, an arm interior surface 38 distal to the pivot 16 and facing the first arm 12, an arm exterior surface 40 opposite the arm interior surface 38, an arm length 44 extending from the pivot 16 to the arm distal end 22, an arm leading/cutting edge 50, an arm lagging/back edge 52, an arm width 58 perpendicular to the arm length 44 and extending from the arm leading edge 50 to the arm lagging edge 52, and an arm thickness 60 perpendicular to the arm width 58 and arm length 44 and extending from the arm interior surface 38 to the arm exterior surface 40.

Optionally, the scissor arms 12 and 14 are configured to pivot about the pivot 16 from an open position in which the arm interior surfaces 34 and 38 do not face each other to a closed position in which the arm interior surfaces face 34 and 38 each other.

Figure 6:
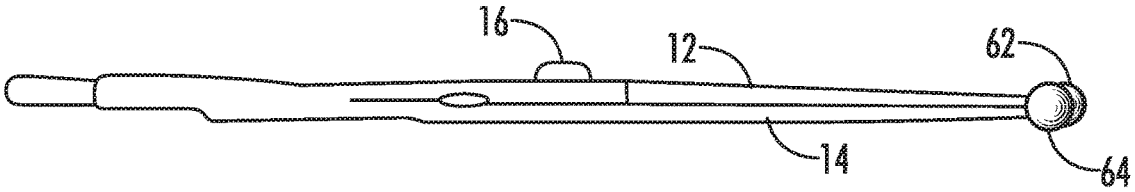
FIG. 6 is a side elevation view of the pair of scissors of FIG. 1 with the scissor arms in the closed position.

One or both scissor arms 12 may include a protrusion 62 and 64. The protrusion 62 and 64 may distally from the arm tip 24 and 32 and may extend laterally beyond the arm tip 24 and 32 and may extend above and below the arm tip 24 and 32 when the arm interior surfaces 34 and 38 are positioned parallel to the ground (i.e., in the orientation shown in FIG. 6, which would be the position when the exterior surface 40 of the scissor arm 14 of FIG. 6 is laid flat on a table). In other words, the arm tip 24 and 32 may include a tip width 104 parallel to the arm width 54 and 58 and a tip thickness parallel to the arm thickness 56 and 60 of the scissor arm 12 and 14, the protrusion 62 and 64 of the scissor arm 12 and 14 comprises a protrusion width/diameter 102 parallel to the arm width 54 and 58 and a protrusion thickness/diameter 110 parallel to the arm thickness 56 and 60, and it is desired that the protrusion thickness 110 is greater than the tip thickness and the protrusion width 102 is greater than the tip width 104. Thus, preferably, the protrusion 62 and 64 extends distally, laterally, and above and below the portion of the scissor arm 12 and 14 immediately proximal to the protrusion 62 and 64. Preferably, the protrusion(s) 62 and 64 radiates 360 degrees (i.e., in every direction) from the tip 24 and 32 of the arm 12 and 14 that the protrusion 62 and 64 extends from, as best seen in FIGS. 6, 9, 10, 17, and 18. In an exemplary embodiment, the protrusions 62 and 64 have a diameter 102 of between about 2 mm and about 6 mm (millimeters) and the arm tips 24 and 32 have a width 104 of between about 1 and about 3 mm.

Figure 14:
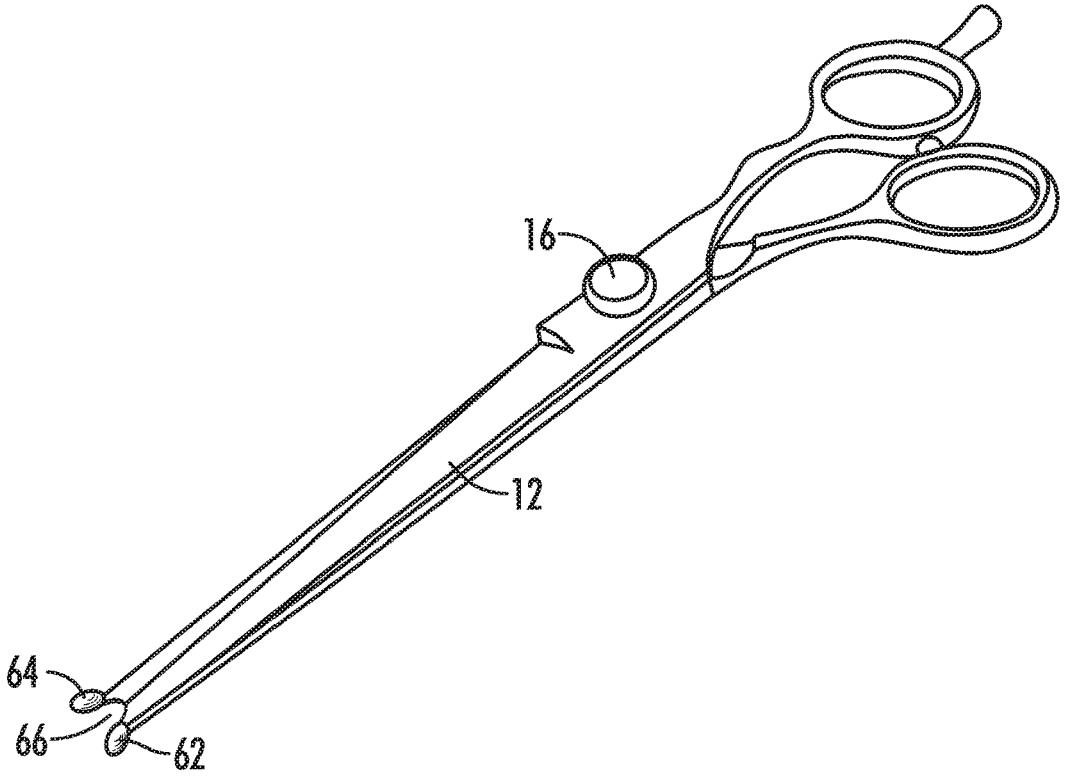
FIG. 14 is a side perspective view of a pair of scissors of another embodiment of the present invention with the scissor arms in the closed position.
Figure 15:
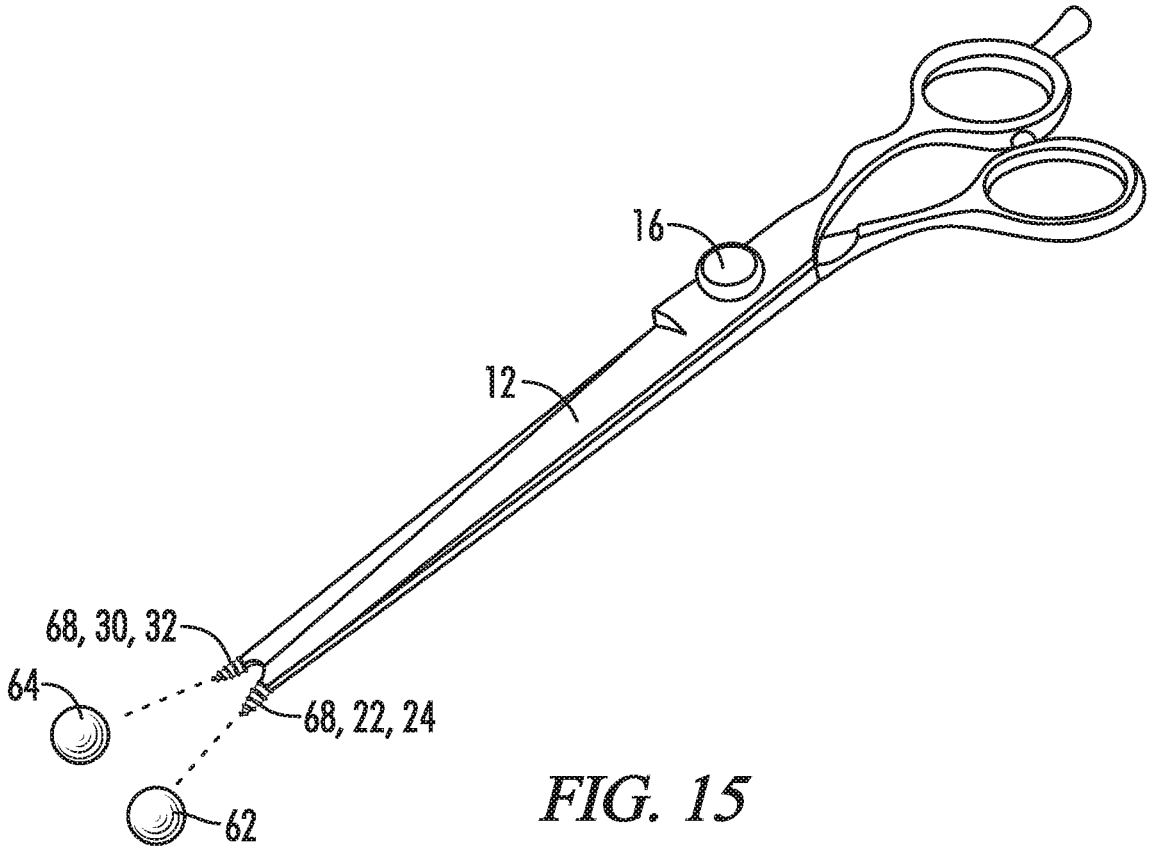
FIG. 15 is a side, exploded perspective view of a pair of scissors of another embodiment of the present invention with the scissor arms in the closed position.
Figure 16:
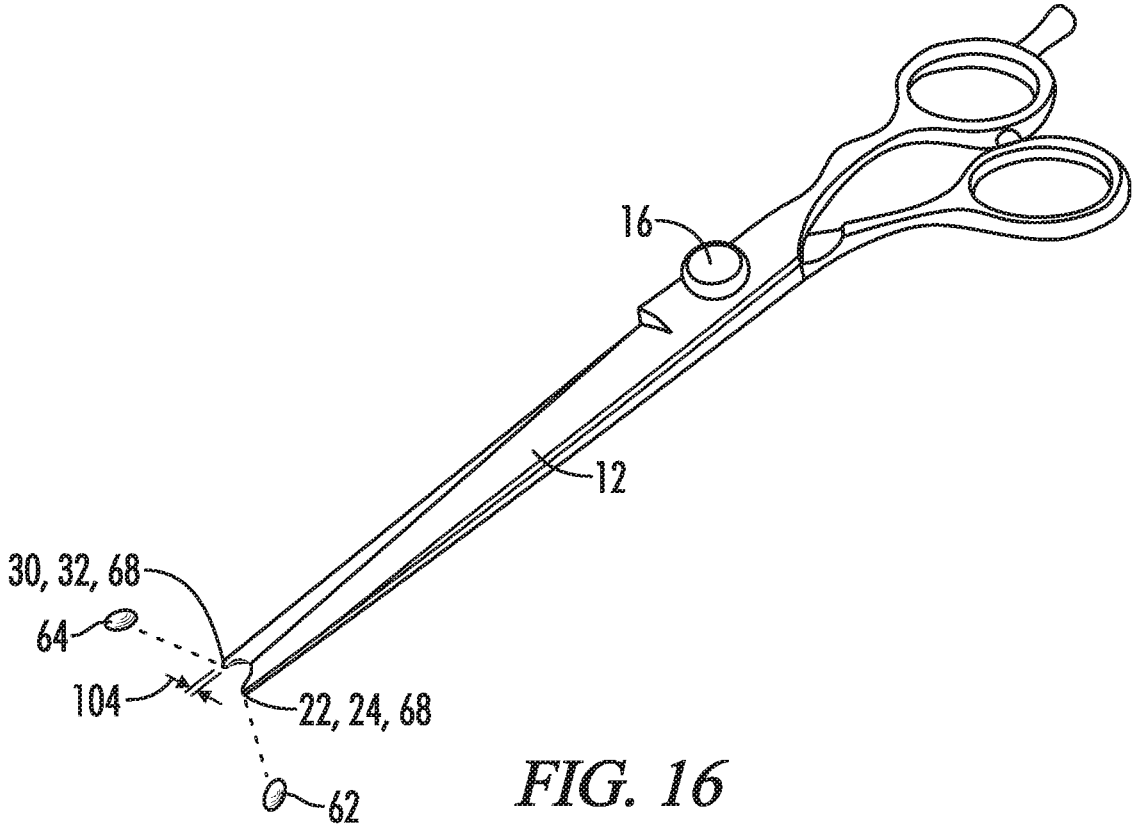
FIG. 16 is a side, exploded perspective view of a pair of scissors of another embodiment of the present invention with the scissor arms in the closed position.

The protrusions 62 and 64 are preferably generally spherical, as shown in FIGS. 1-13, 15, and 17-22 or ovoidal as shown in FIGS. 14 and 16. Preferably, the arm tips 24 and 32 of the scissor arms 12 and 14 do not touch or overlap each other and are disposed laterally to each other in the widthwise direction (but not necessarily in the same plane) when the scissor arms 12 and 14 are in the closed position, as best seen in FIG. 16, and also shown in FIGS. 1, 3-5, 7, 11, 13, 14, 20, and 22. Preferably, the pair of scissors 10 comprises a recess 66 between the arm tips 24 and 32 when the scissor arms 12 and 14 are in the closed position.

The protrusions 62 and 64 may be attached to the arm tip 24 and 32 by any suitable method. For example, FIG. 15 shows removable attachment of the protrusions 62 and 64 to the scissor arms 12 and 14 via threads 68. In other embodiments, the protrusions 62 and 64 may be dipped, cast, molded, shaped, cut, or attached to the arm tip 24 and 32. Preferably, the protrusion 62 and 64 is a discrete component from the arm 12 and 14 and may be made of a different material as compared to the scissor arm 12 and 14 which is generally made out of steel or other metal. In an exemplary embodiment, the protrusion 62 and 64 may be in the form of epoxy resin or another substance that can harden from liquid form and the protrusion 62 and 64 may be removed from the arm tip 24 and 32 by dipping the protrusion 62 and 64 in a solvent.

Preferably, the protrusions 62 and 64 are substantially aligned in a plane comprising the arm widths 54 and 58 when the scissor arms 12 and 14 are in the closed position, as shown in FIGS. 1, 3, 4, 5, 6, 7, 9, 10, 11, 13, 14, 17, 18, 20 and 22. Preferably, the generally spherical protrusions 62 and 64 do not touch and are disposed laterally to each other in the widthwise direction (but not necessarily in the same plane) when the scissor arms 12 and 14 are in the closed position, as shown in the aforementioned Figures. In an exemplary embodiment, there is a gap 100 between the protrusions 62 and 64 of between about 1 mm and about 3 mm when the scissor arms 12 and 14 are in the closed position.

Figure 2:
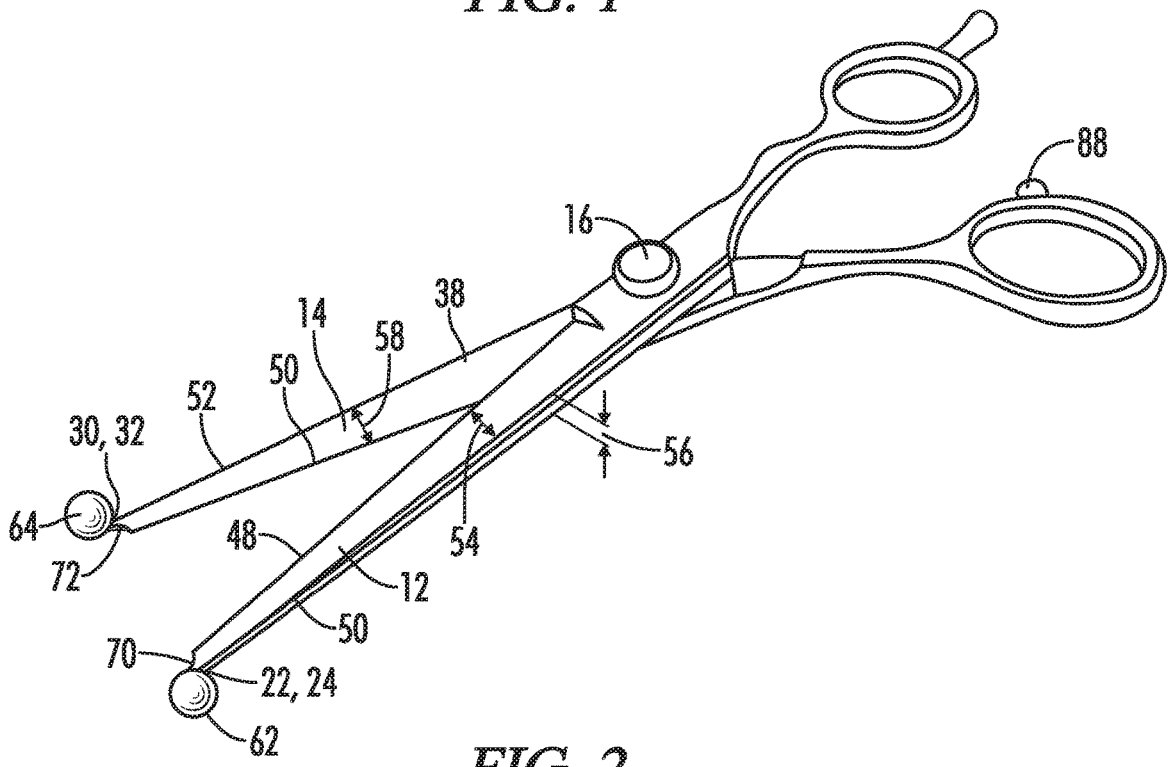
FIG. 2 is a side perspective view of the pair of scissors of FIG. 1 with the scissor arms in the open position.
Figure 3:
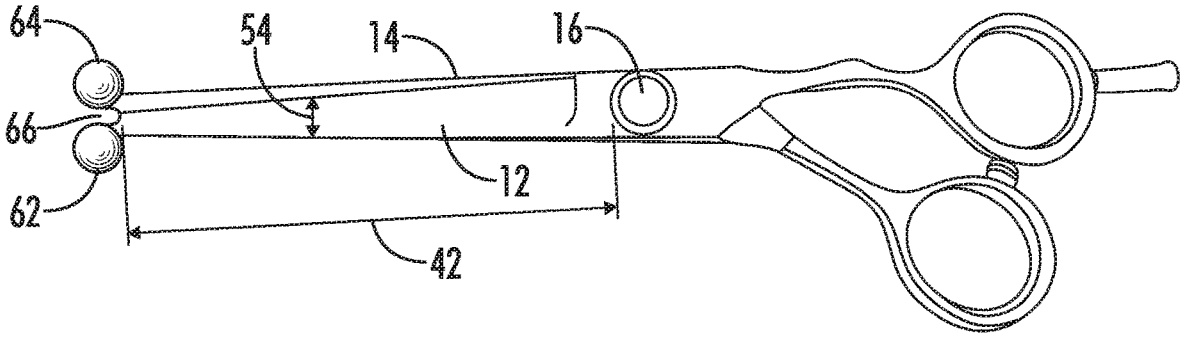
FIG. 3 is a top plan view of the pair of scissors of FIG. 1 with the scissor arms in the closed position.
Figure 4:
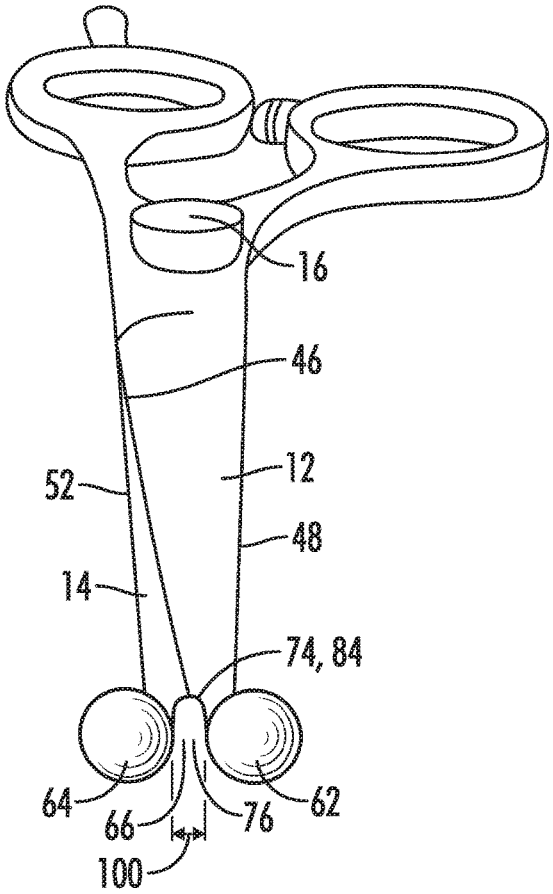
FIG. 4 is a distal perspective view of the pair of scissors of FIG. 1 with the scissor arms in the closed position.
Figure 5:
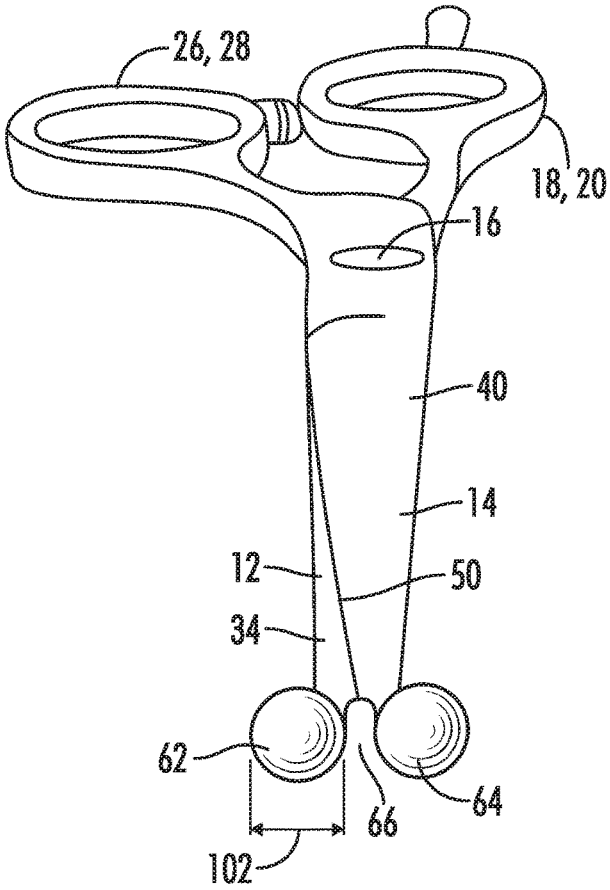
FIG. 5 is a distal perspective view of the pair of scissors of FIG. 1 with the scissor arms in the closed position; as compared to FIG. 4, in FIG. 5, the pair of scissors have been inverted.
Figure 11:
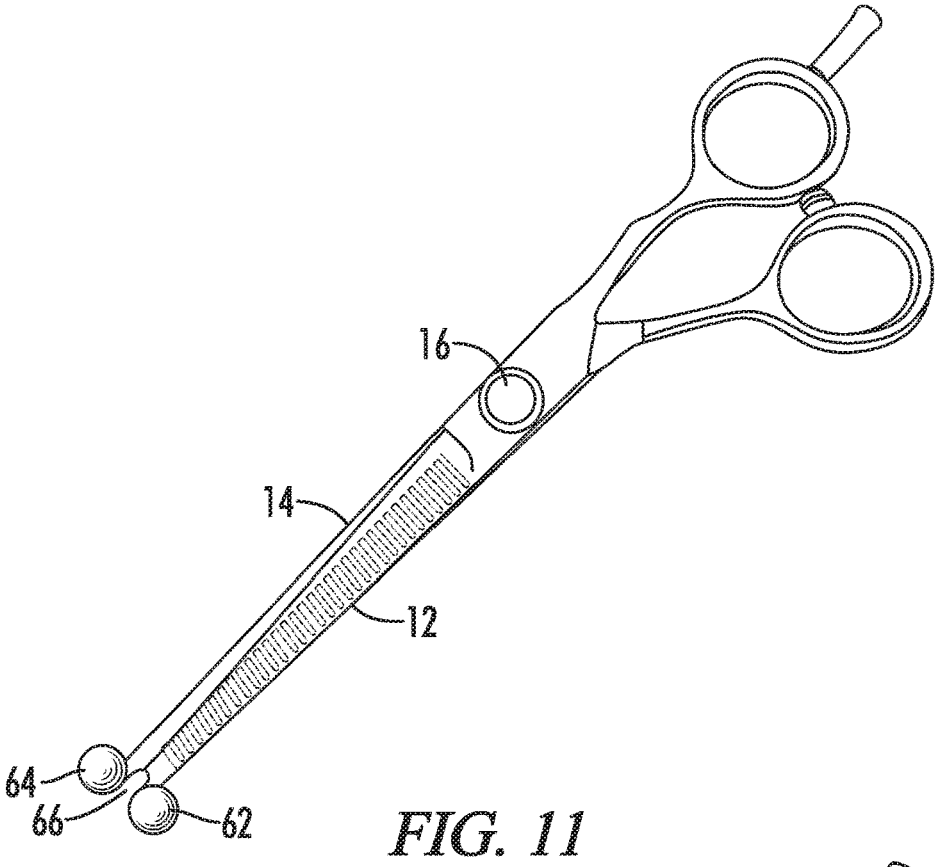
FIG. 11 is a side perspective view of a pair of thinning scissors of another embodiment of the present invention with the scissor arms in the closed position.
Figure 12:
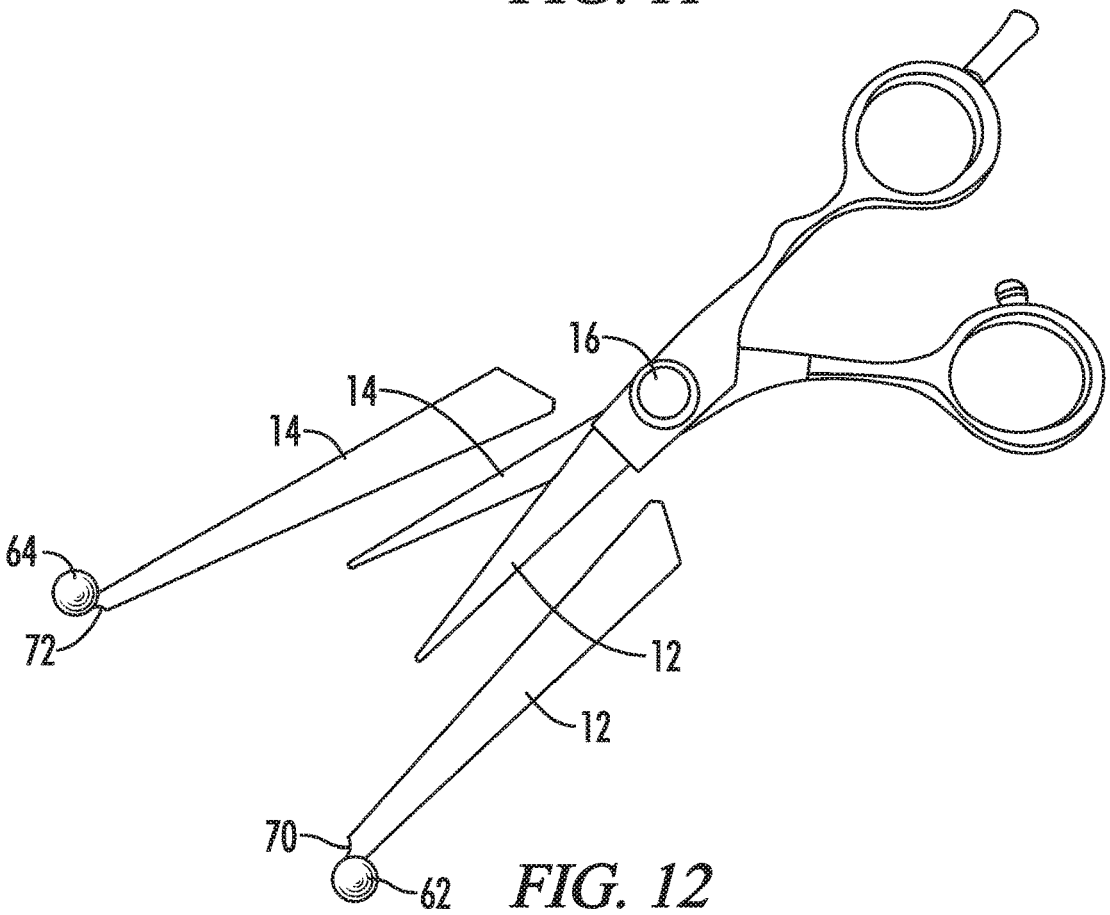
FIG. 12 is a side, exploded perspective view of a pair of scissors of another embodiment of the present invention with the scissor arms in the open position.
Figure 13:
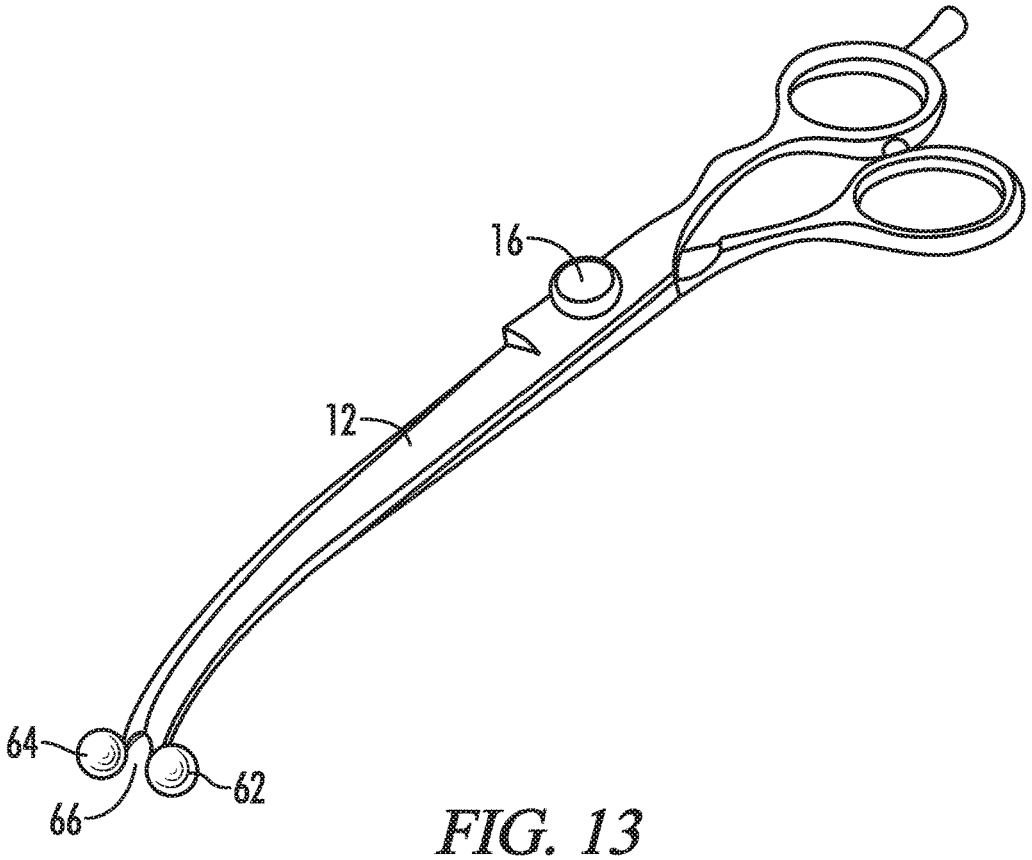
FIG. 13 is a side perspective view of a pair of scissors of another embodiment of the present invention with the scissor arms in the closed position.
Figure 23:
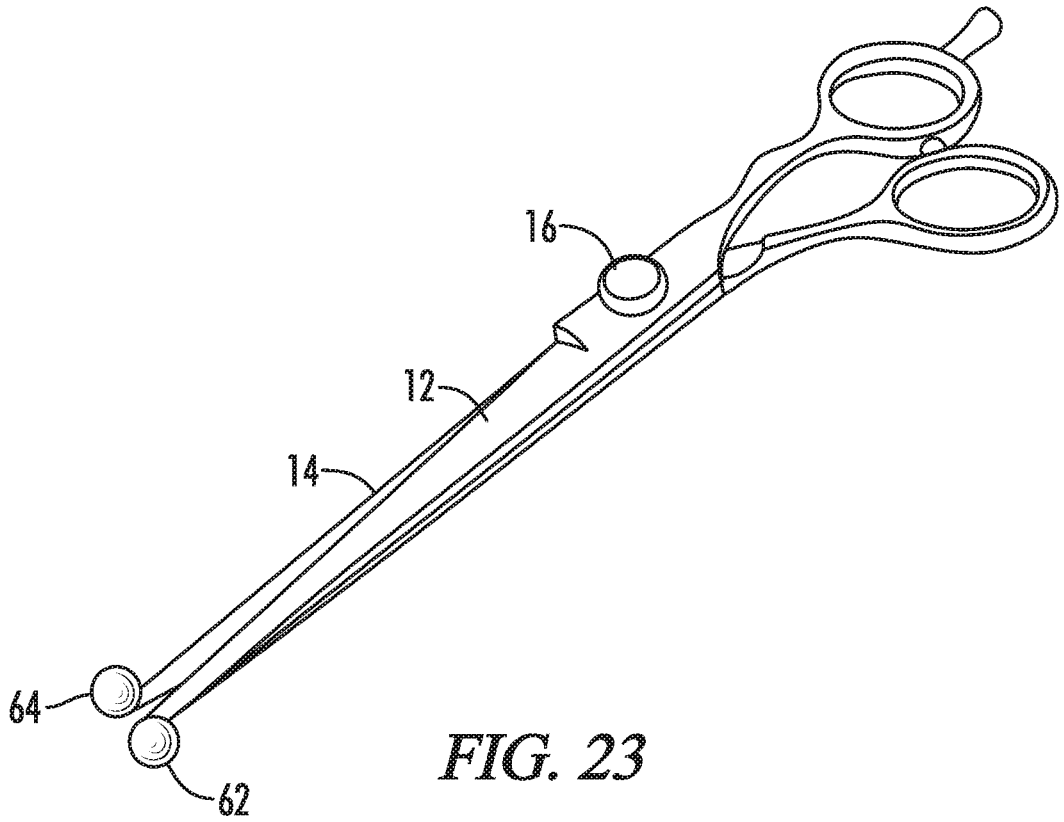
FIG. 23 is a side perspective view of a pair of scissors of an alternate embodiment of the present invention that does not include a cut-out.
Figure 24:
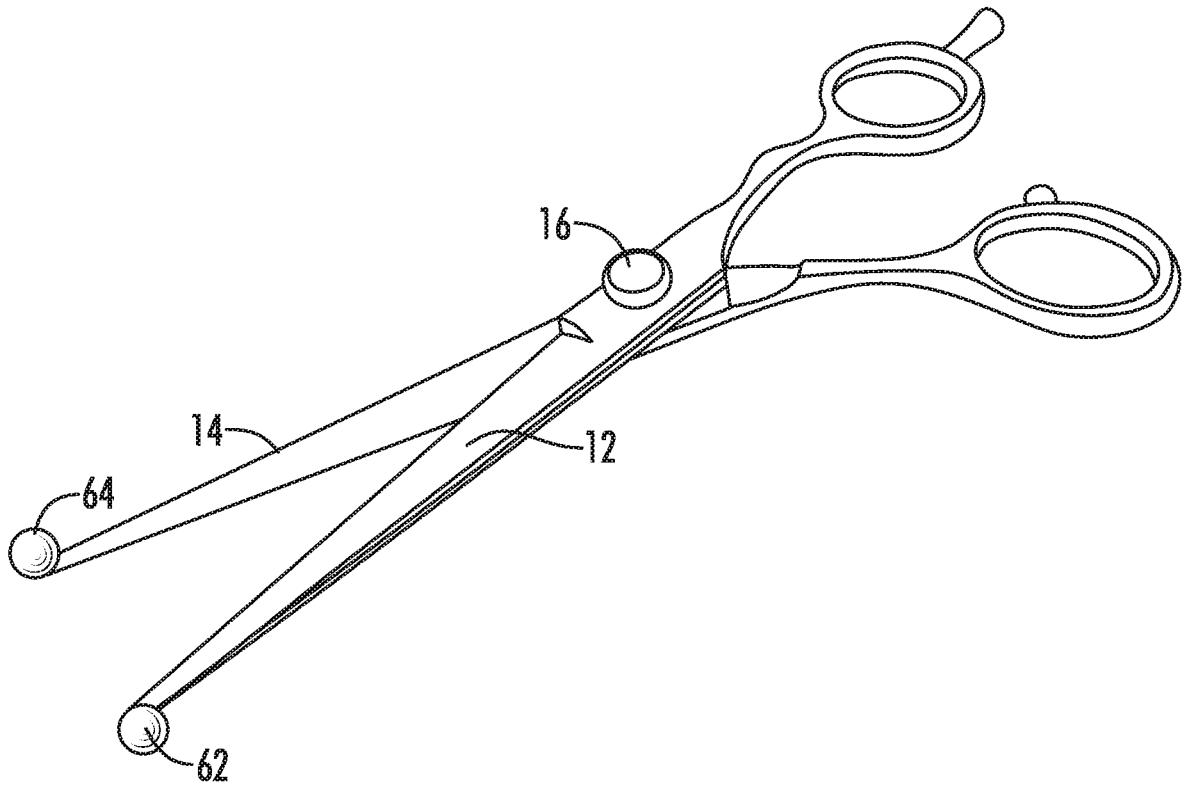
FIG. 24 is a side perspective view of the pair of scissors of FIG. 23 with the scissor arms in the open position.

Preferably, the leading edge/cutting edge 46 and 50 of each scissor arm 12 and 14 represents the edge of the arm 12 and 14 closest to the other arm 12 and 14 when the scissor arms 12 and 14 are in the open position. Preferably, the leading edge 46 and 50 of each scissor arm 12 and 14 comprises a cut-out 70 and 72 adjacent to the arm tip 24 and 32 and the cut-outs 70 and 72 form the recess 66. Preferably, the cut-out 70 and 72 of each arm 12 and 14 is generally in the shape of one-half of an arc, as best seen in FIGS. 2, 8, and 12, and the recess 66 (formed when the scissor arms 12 and 14 are in the closed position) is generally in the shape of an arc, as shown in FIGS. 1, 3, 4, 5, 7, 11, 13, 14, 16. In an exemplary embodiment, the length 108 of cut-outs 70 and 72 are from about 2 mm to about 6 mm. Preferably, the protrusions 62 and 64 extend distally beyond the cut-outs 72 and 74, above and below the cut-outs 70 and 72 and laterally beyond the cut-outs 72 and 74. The distal ends of the cut-outs 72 and 74 preferably form the arm tips 24 and 32. If only a single protrusion 62 or 64 is present in the pair of scissors 10, the arm 12 or 14 that includes the protrusion 62 and 64 preferably includes the cut-out 72 or 74 and the other arm 12 or 14 either 1) includes the cut-out 72 or 74; or 2) does not extend past the cutting part of the arm 12 or 14 with the protrusion 62 or 64. The cut-outs do improve efficacy of cutting but are not required for the pair of scissors 10 to fully function. Thus, FIGS. 23-24 show scissors 10 without the cut-out.

Figure 7:
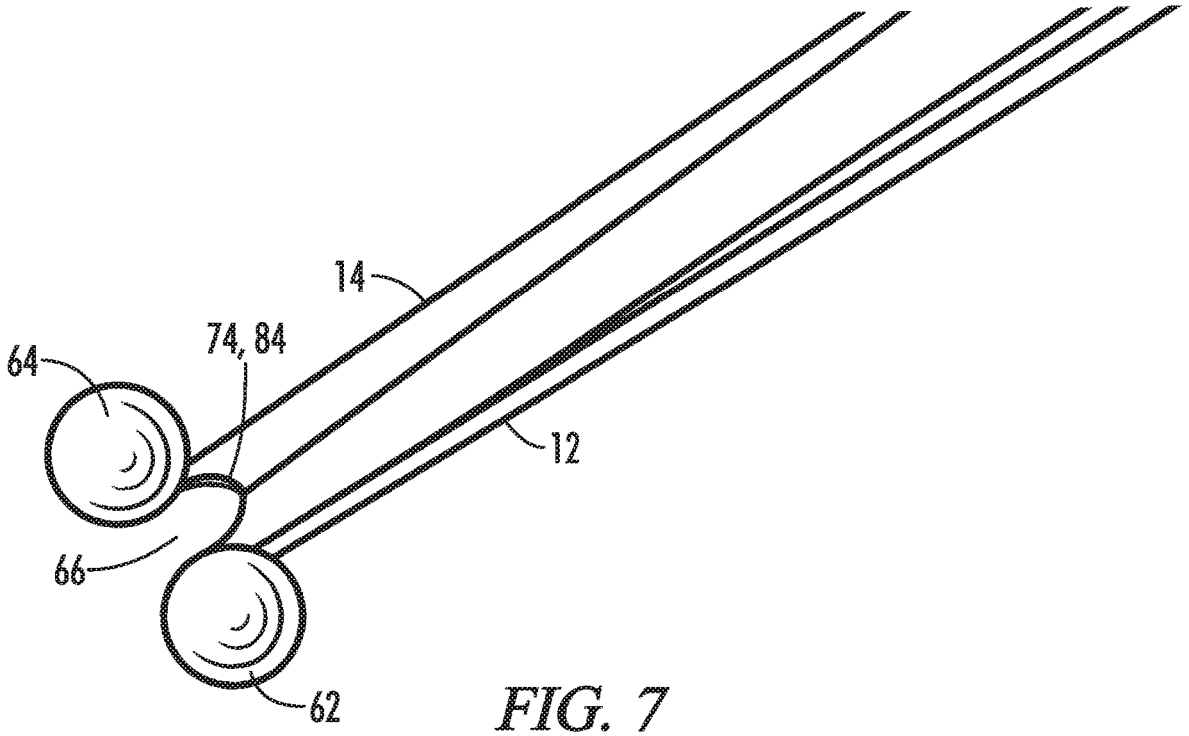
FIG. 7 is a side perspective view of the distal portion of the pair of scissors of FIG. 1 with the scissor arms in the closed position.
Figure 8:
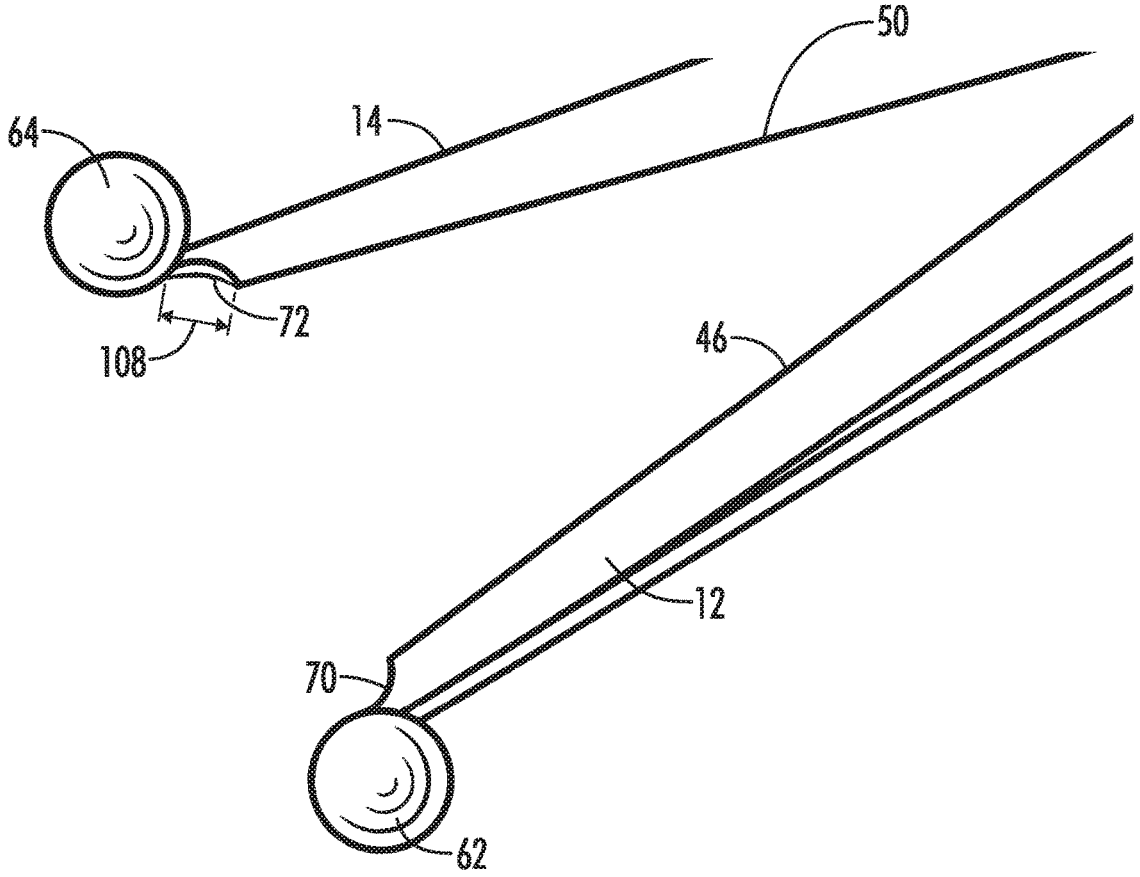
FIG. 8 is a side perspective view of the distal portion of the pair of scissors of FIG. 1 with the scissor arms in the open position.
Figure 9:
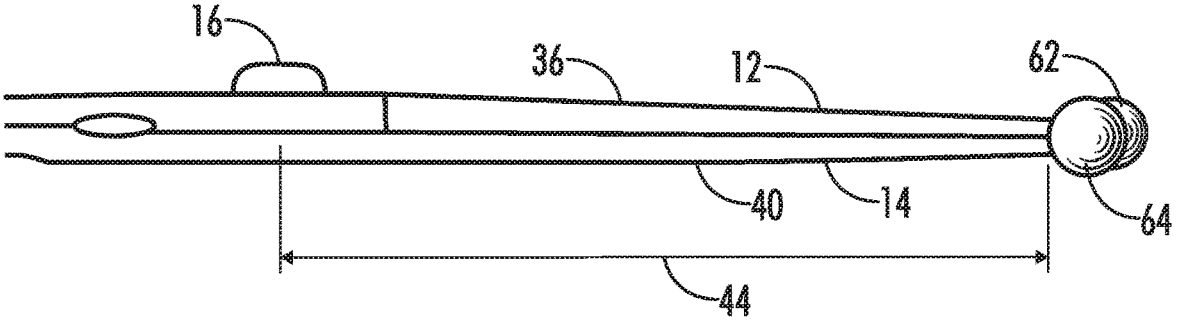
FIG. 9 is a side elevation view of the distal portion of the pair of scissors of FIG. 1 with the scissor arms in the closed position.
Figure 10:
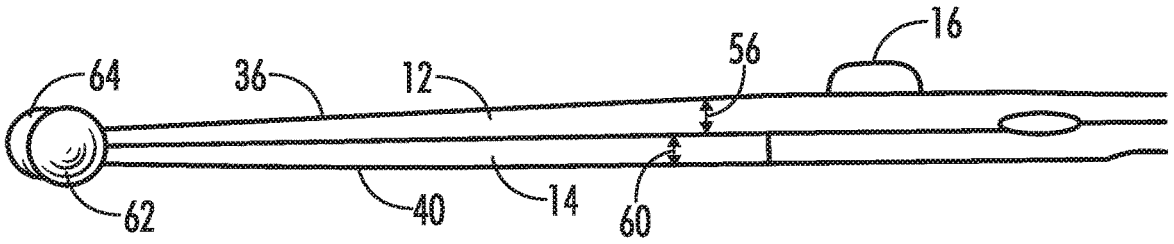
FIG. 10 is a side elevation view of the distal portion of the pair of scissors of FIG. 1 with the scissor arms in the closed position; as compared to FIG. 9, in FIG. 10, the pair of scissors have been rotated 180 degrees.

Optionally, the generally arc-shaped recess 66 comprises an apex 84, and the leading edges 46 and 50 of the scissor arms 12 and 14 distal to the apex 84 do not contact each other or overlap each other and are disposed laterally to each other in the widthwise direction when the scissor arms 12 and 14 are in the closed position, as shown in FIGS. 1, 3, 4, 5, 7, 11, 13, 14, 16. In other words, the recess 66 may comprise a proximal end 74 comprising the apex 84 and a distal end 76, and the leading edges 46 and 50 of the scissor arms 12 and 14 do not contact or overlap each other distal to the proximal end 74 of the recess 66 and are disposed laterally to each other in the widthwise direction when the scissor arms 12 and 14 are in the closed position. Preferably, the leading edges 46 and 50 of the respective scissor arms 12 and 14 slope away from each other distal to the recess proximal end 74 when the scissor arms 12 and 14 are in the closed position, as best seen in FIG. 7. Preferably, the protrusions 62 and 64 are located approximately the same distance from the pivot 16, as best seen in FIGS. 9, 10, 17 and 18. The pair of scissors 10 may include a stopper/silencer 88 to prevent over pivoting of the scissor arms 12 and 14.

The pair of scissors 10 may be used for any suitable purpose, including for cutting hair 82 on an animal such as a human or pet.

Figure 17:
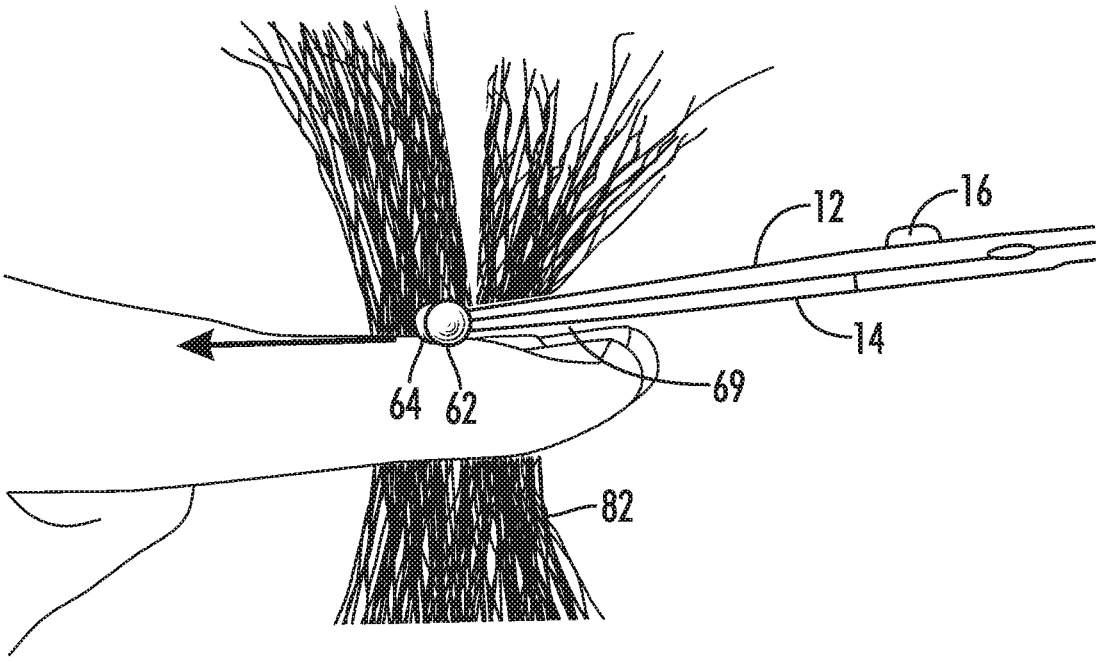
FIG. 17 is a side, exploded perspective view of the pair of scissors of FIG. 1 cutting hair.
Figure 18:
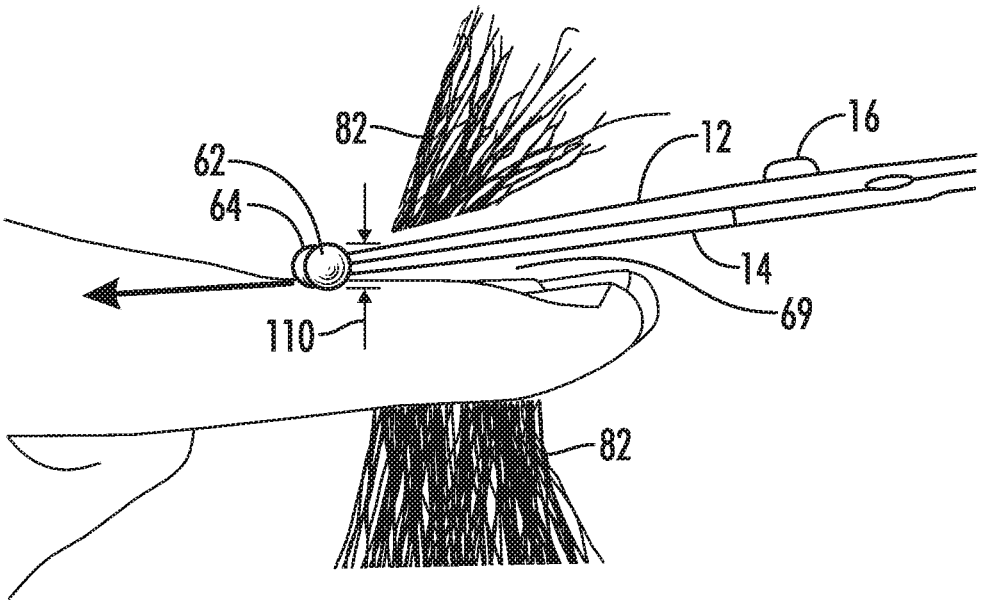
FIG. 18 is a side, exploded perspective view of the pair of scissors of FIG. 1 cutting hair.
Figure 19:
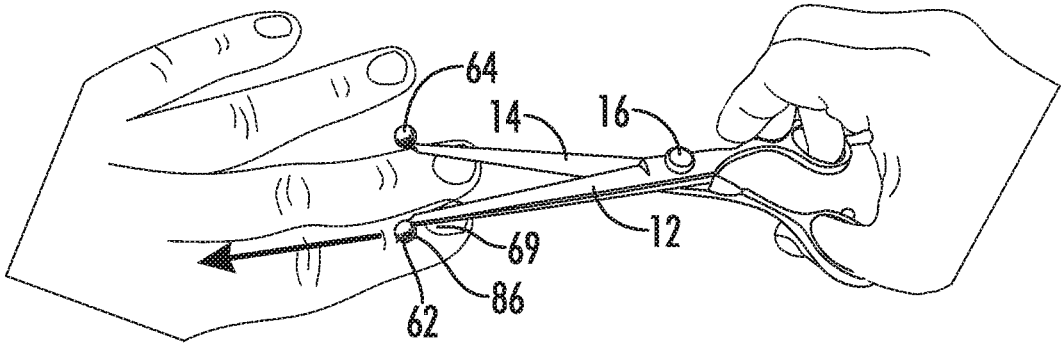
FIGS. 19-22 are side, exploded perspective views of the pair of scissors of FIG. 1 interacting with a barber's hands.

Without being bound by any particular theory, the protrusions 62 and 64 function to provide a dull end to the pair of scissors 10, and the recess 66 allows the scissor arms 12 and 14 to ensure that the protrusions 62 and 64 do not interfere with cutting efficacy. The pair of scissors 10 may include a finger rest 78 for example if it is desired that they cut hair 82. The pair of scissors 10 may also be in the form of thinning scissors if so desired, as shown in FIG. 11. FIGS. 17-22 illustrate use of the pair of scissors 10 cutting hair 82 and being moved in the direction of the directional arrow. As shown in FIGS. 17-22, the protrusions 62 and 64 may create a protective space 69 between the barber's hand and the leading edge/cutting edge 46 and 50 of the scissor arm 12 and 14 for safety. The recess 66 also keeps the hair 82 from getting pinched allowing the scissor arms 12 and 14 to close completely, cut properly and protect the barber and client. The protrusions 62 and 64 may contact the barber's fingers that are holding the hair 82 at a point of contact denoted by numeral 86. As best seen in FIGS. 17-18, the hair 82 protrudes upwardly between the scissor arms 12 and 14, and the protrusions 62 and 64 glide rearwardly/distally along the fingers of the barbers (on the hand that is not holding the scissor arms 12 and 14) and the hair 82 actually helps center the protrusions 62 and 64 along the middle of the user's fingers so the protrusions 62 and 64 don't slip off of the fingers. Without being bound to any particular theory, the protrusions 62 and 64, which radiate from all directions from the tips 24 and 32, protect the barber at any plane in which the protrusions 62 and 64 glide distally along the barber's fingers.

Figure 20:
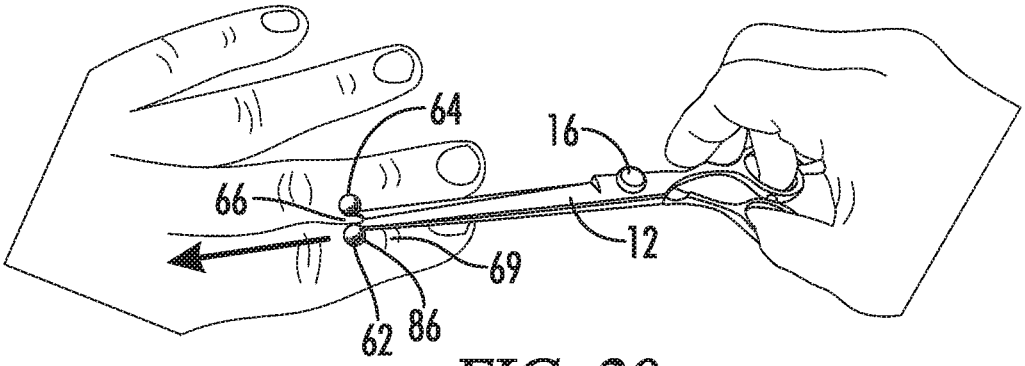
Figure 21:
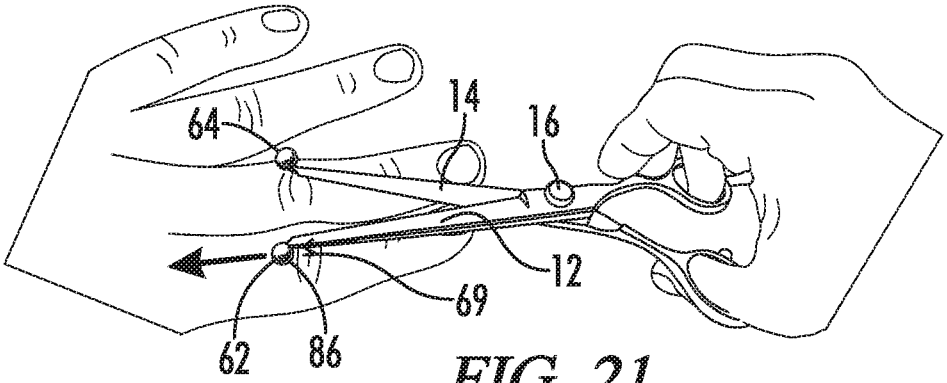
Figure 22:
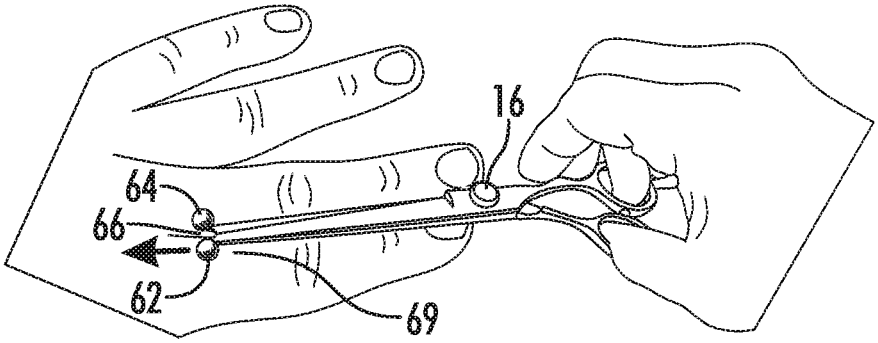

More particularly, with reference to the stepwise progression of cutting hair 82, shown in FIGS. 19-22, FIG. 19 shows the first step with the scissor arms 12 and 14 in the open position and contacting the barber's fingers at point of contact 86 to create the protective space 69 at the beginning of the cutting path. FIG. 20 maintains the point of contact 86 creating a protective space 69 and the protrusions 62 and 64 are slid along the barber's fingers. FIG. 21 shows the scissor arms 12 and 14 in the open position and the barber maintaining the point of contact 69 between the protrusion 12 and 14 and the barber's fingers and the protrusion 12 and 14 is continued to be slide along the barber's fingers. FIG. 22 maintains the point of contact 86 creating a protective space 69 and the protrusions 62 and 64 are slid along the barber's fingers and the scissor arms 12 and 14 are moved to the closed position. As shown in FIG. 22, the recess 66 (the non-cutting space) between the closed arms 12 and 14 keeps the hair 82 from getting pinched, allowing the scissor arms 12 and 14 to close completely and cut properly and protect the barber and client. As shown in FIGS. 19-22, one scissor arm may be held stationary relative to the pivot 16 while the other arm is moved about pivot 16; in FIGS. 19-22, the arm moved about pivot is arm 14 while arm 12 does not move about pivot 16.

PART LIST

| | |
|---|---|
| pair of scissors | 10 |
| scissor arm 1 | 12 |
| scisson arm 2 | 14 |
| pivot | 16 |
| arm 1 proximal end | 18 |
| arm 1 handle | 20 |
| arm 1 distal end | 22 |
| arm 1 tip | 24 |
| arm 2 proximal end | 26 |
| arm 2 handle | 28 |
| arm 2 distal end | 30 |
| arm 2 tip | 32 |
| arm 1 interior surface | 34 |
| arm 1 exterior surface | 36 |
| arm 2 interior surface | 38 |
| arm 2 exterior surface | 40 |
| arm 1 length | 42 |
| arm 2 length | 44 |
| arm 1 leading edge | 46 |
| arm 1 lagging edge | 48 |
| arm 2 leading edge | 50 |

-continued

| | |
|---|---|
| arm 2 lagging edge | 52 |
| arm 1 width | 54 |
| arm 1 thickness | 56 |
| arm 2 width | 58 |
| arm 2 thickness | 60 |
| arm 1 protrusion | 62 |
| arm 2 protrusion | 64 |
| recess | 66 |
| tip threads | 68 |
| arm 1 cut-out | 70 |
| arm 2 cutout | 72 |
| recess proximal end | 74 |
| recess distal end | 76 |
| finger rest | 78 |
| hair | 82 |
| arc apex | 84 |
| protective space | 69 |
| point of contact | 86 |
| stopper/silencer | 88 |

Having now described the invention in accordance with the requirements of the patent statutes, those skilled in the art will understand how to make changes and modifications to the disclosed embodiments to meet their specific requirements or conditions. All dimensions provided herein are exemplary. Changes and modifications may be made without departing from the scope and spirit of the invention. In addition, the steps of any method described herein may be performed in any suitable order and steps may be performed simultaneously if needed.

Terms of degree such as "generally", "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

What is claimed is:

1. A pair of scissors comprising:

a pair of oppositely moveable scissor arms pivotably connected to each other by a pivot, the scissor arms each comprising an arm proximal end forming a handle, an arm distal end forming an arm tip, an arm interior surface distal to the pivot, an arm exterior surface opposite the arm interior surface, an arm length extending from the pivot to the arm distal end, an arm leading edge, an arm lagging edge, an arm width perpendicular to the arm length and extending from the arm leading edge to the arm lagging edge, and an arm thickness perpendicular to the arm width and arm length and extending from the arm interior surface to the arm exterior surface, wherein the scissor arms are configured to pivot about the pivot from an open position in which the arm interior surfaces are spaced apart from each other and the handles are also spaced apart from each other and do not contact each other, to a closed position in which a major portion of the arm interior surfaces are in contact with each other and the handles are in contact with each other, wherein each scissor arm comprises a spherical protrusion extending distally and radiating 360 degrees from the tip of the scissor arms, wherein the tips of the arms slope away from each other wherein the spherical protrusions located at the arm tips of the scissor arms do not touch each other, and a recess is created between the arm tips and between the respective spherical protrusions when said pair of arms are in the closed position, to provide a protective space between the cutting edges of the scissors and a user's hands and prevent hair from being pinched while the scissors are in said closed position.

2. The pair of scissors of claim 1 wherein the spherical protrusions are removably attached to the arm tips.

3. The pair of scissors of claim 1 wherein the spherical protrusions are integral with the arm tips.

4. The pair of scissors of claim 1 wherein the spherical protrusions are substantially aligned in a plane comprising the arm widths when the scissor arms are in the closed position.

5. The pair of scissors of claim 1 wherein the spherical protrusions do not touch and are disposed laterally to each other in the widthwise direction in the same plane when the scissor arms are in the closed position.

6. The pair of scissors of claim 1 wherein the leading edge of each scissor arm represents the edge of the arm closest to the other arm when the scissor arms are in the open position, and further wherein the leading edge of each scissor arm comprises a cut-out adjacent to the arm tip and further wherein the cut-outs form the recess.

7. The pair of scissors of claim 6 wherein the cut-out of each arm is generally in the shape of one-half of an arc and further wherein the recess is generally in the shape of an arc.

8. The pair of scissors of claim 7 wherein the generally arc-shaped recess comprises an apex, and further wherein the leading edges of the scissor arms distal to the apex do not contact each other or overlap each other and are disposed laterally to each other in the widthwise direction when the scissor arms are in the closed position.

9. The pair of scissor arms of claim 1 wherein the leading edge of each scissor arm represents the edge of the arm closest to the other arm when the scissor arms are in the open position, wherein the recess comprises a proximal end and a distal end, and further wherein the leading edges of the scissor arms do not contact or overlap each other distal to the proximal end of the recess and are disposed laterally to each other in the widthwise direction when the scissor arms are in the closed position.

10. The pair of scissors of claim 1 wherein the spherical protrusions radiate 360 degrees from the arm tips.

11. The pair of scissors of claim 1 wherein the spherical protrusions are located approximately the same distance from the pivot.

* * * * *